United States Patent [19]

Tyler

[11] 4,131,787

[45] Dec. 26, 1978

[54] ELECTRICAL HEATER CONSTRUCTION

[75] Inventor: Hugh J. Tyler, Santa Ana, Calif.

[73] Assignee: Robertshaw Controls Company, Richmond, Va.

[21] Appl. No.: 806,846

[22] Filed: Jun. 15, 1977

[51] Int. Cl.[2] ..... H05B 3/06

[52] U.S. Cl. ..... 219/532; 219/403; 219/483; 219/517; 219/536; 219/541; 337/245

[58] Field of Search ..... 219/321, 403, 483, 486, 219/510, 517, 532, 536, 538, 541; 165/39; 337/245

[56] References Cited

U.S. PATENT DOCUMENTS

| | | | |
|---|---|---|---|
| 3,016,441 | 1/1962 | Hackman et al. | 219/532 |
| 3,235,189 | 3/1966 | Bunting | 219/371 |
| 3,435,189 | 3/1969 | Manecke | 219/321 |
| 3,548,154 | 12/1970 | Christiansson | 219/403 |
| 3,697,727 | 10/1972 | Neuman et al. | 219/532 |
| 3,770,939 | 11/1973 | Kokjohn | 219/532 |
| 3,912,906 | 10/1975 | McIntash | 219/486 |
| 4,007,780 | 2/1977 | Caldwell et al. | 165/39 |
| 4,076,975 | 2/1978 | Tyler et al. | 219/483 |

*Primary Examiner*—Volodymyr Y. Mayewsky
*Attorney, Agent, or Firm*—Candor, Candor & Tassone

[57] ABSTRACT

Electrical heater construction having a substantially closed housing containing controls therein and having a bracket unit carrying electrical heaters externally thereof, the housing having connectors detachably interconnected to the heaters externally to the housing and electrically interconnecting the heaters to the controls within the housing to be operated thereby. The housing has an externally accessible detachable arrangement and the bracket unit has a detachable arrangement detachably interconnected to the detachable arrangement of the housing in a manner that is accessible externally to the housing whereby the detachable arrangement of the bracket unit can be detached from the detachable arrangement of the housing without access to the interior of the housing so that the heaters can be detached from and/or attached to the housing without requiring the opening of the housing.

10 Claims, 6 Drawing Figures

ELECTRICAL HEATER CONSTRUCTION

This invention relates to an improved electrical heater construction and method for making the same.

It is well known that electrical heater constructions have been provided for electrical furnaces and the like wherein each electrical heater construction includes control means for interconnecting power source leads to the heater elements thereof.

For example, the copending patent application, Ser. No. 661,056, filed February 25, 1976 now U.S. Pat. No. 4,076,975, discloses and claims an improved electrical heater construction that has a frame means carrying a plurality of electrical heaters and a control means therefor. A rigid lead module is carried by the frame means and has rigid lead means directly and electrically interconnected to the terminal means of the heaters and the control means, the lead module itself having terminal means for electrically interconnecting the rigid lead means thereof to power source leads whereby the power source leads will be directly interconnected to the terminal means of the heaters and the control means by the rigid lead means. In this manner, external wiring for the control system is held to an absolute minimum. The rigid lead module includes a plurality of drawer-like units or sections that contain fuse means in the rigid lead means thereof, the drawer-like units when pulled from an "in" position thereof, disconnecting the main power source leads from the terminal means of the electrical heaters and the control means to terminate an operation thereof.

Such electrical heater construction of the aforementioned copending patent application fully discloses how such frame means forms an enclosed housing means that contains the electrical control means for operating the heater elements, the heater elements being carried by bracket means that are fastened to the housing means by portions of the bracket means projecting through opening means in the housing means and being bolted or otherwise fastened on the inside surface of the housing means.

However, it was found that it may be desirable to form and manufacture the housing means and the parts therein in one location and, thereafter, have the electrical heater means be attached to such housing means at another location. This would necessitate the opening of the completed housing means so that the bracket means of the heater means could be attached thereto in the manner previously described whereby such opening of the housing means for such heater attachment purposes might cause damage, etc. to the control means therein.

Therefore, it was found according to the teachings of this invention that the bracket means of the heater means could be made in a manner hereinafter set forth to be attached to the housing means without requiring the opening of the housing means as in the past.

Thus, it is a feature of this invention to provide means for attaching the electrical heater means of the aforementioned electrical heater construction to the housing means thereof without requiring an opening of such housing means.

In particular, one embodiment of this invention provides an electrical heater construction having a substantially closed housing means containing control means therein and having bracket means carrying electrical heater means externally thereof, the housing means having connection means detachably interconnected to the heater means externally to the housing means and electrically interconnecting the electrical heater means to the control means to be operated thereby. The housing means has externally accessible detachable means and the bracket means has detachable means detachably interconnected to the detachable means of the housing means in a manner that is accessible externally to the housing means whereby the detachable means of the bracket means can be detached from the detachable means of the housing means without access to the interior of the housing means so that the heater means can be detached from and/or attached to the housing means without requiring the opening of the housing means.

Accordingly, it is an object of this invention to provide an improved electrical heater construction having one or more of the novel features of this invention as set forth above or hereinafter shown or described.

Another object of this invention is to provide a method of making an electrical heater construction, the method of this invention having one or more of the novel features of this invention as set forth above or hereinafter shown or described.

Other objects, uses and advantages of this invention are apparent from a reading of this description which proceeds with reference to the accompanying drawings forming a part thereof, and wherein.

Figure 1:
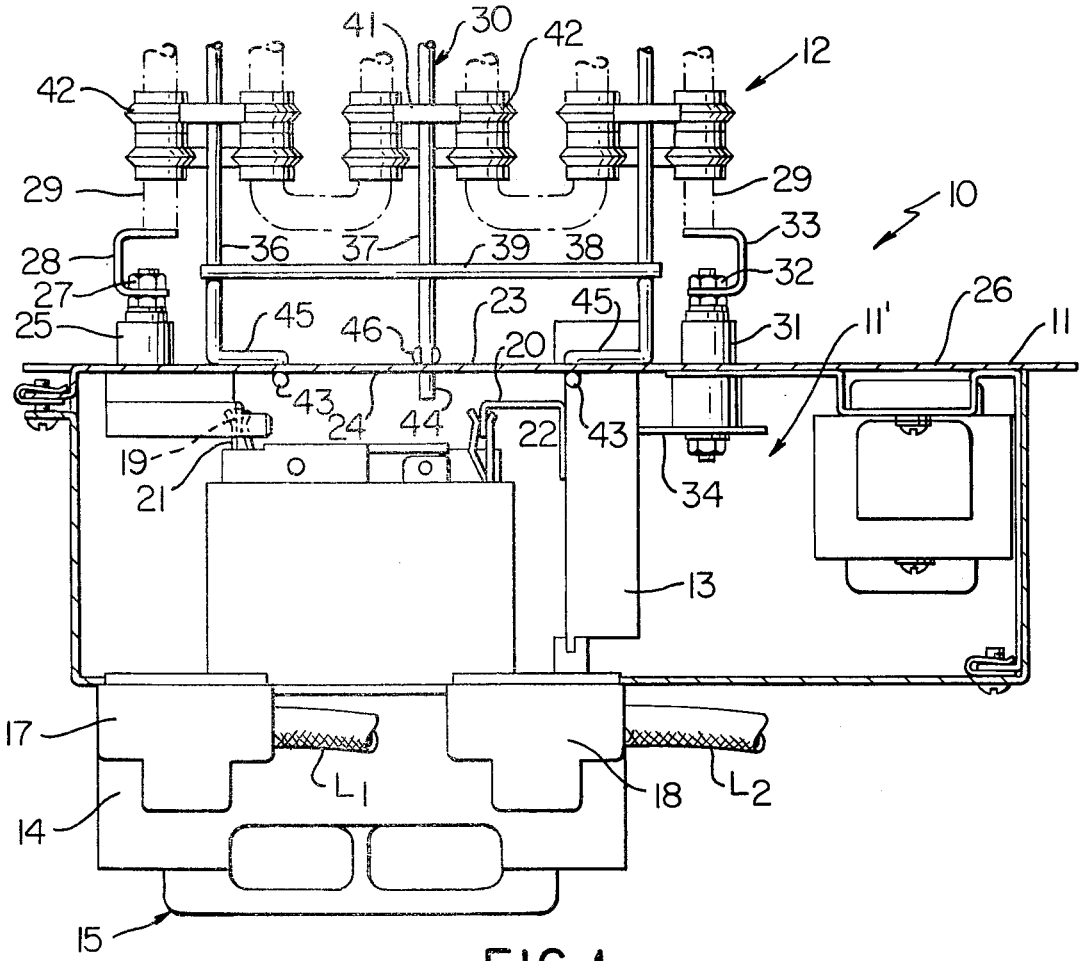
FIG. 1 is a fragmentary, partial cross-sectional top view of the improved electrical heater construction of this invention.

While the various features of this invention are hereinafter illustrated and described as being particularly adapted to provide an electrical heater construction for an electrical furnace, it is to be understood that the various features of this invention can be utilized singly or in any combination thereof to provide an electrical heater construction for other devices as desired.

Therefore, this invention is not to be limited to only the embodiment illustrated in the drawings, because the drawings are merely utilized to illustrate one of the wide variety of uses of this invention.

Figure 2:
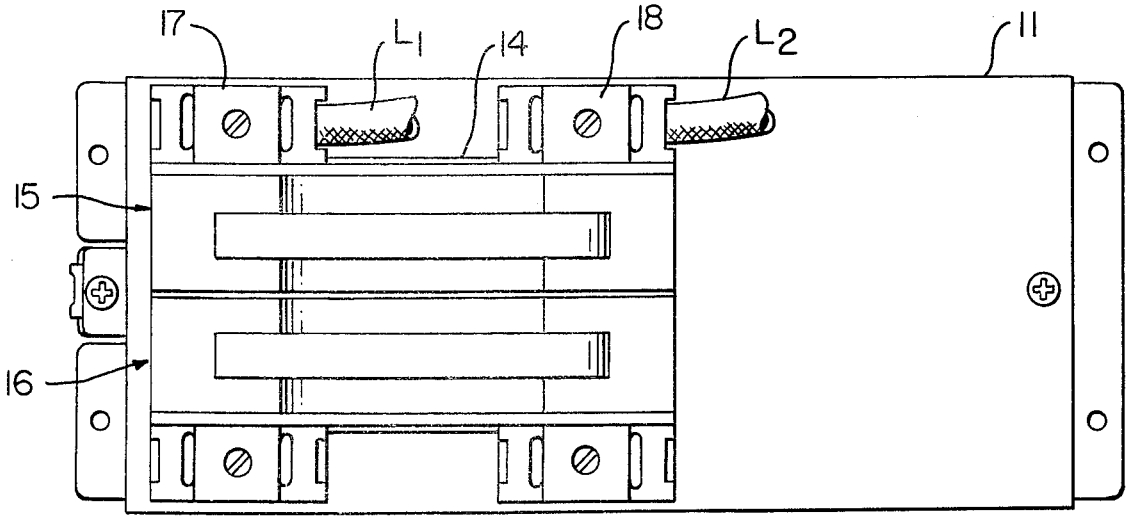
FIG. 2 is a front view of the electrical heater construction of FIG. 1.

Referring now to FIGS. 1 and 2, the improved electrical heater construction of this invention for an electrical furnace or the like is generally indicated by the reference numeral 10 and comprises a frame means or housing means 11 adapted to be secured in an electrical furnace or the like in such a manner that a unit of one or more electrical heaters that is generally indicated by the reference numeral 12 is carried by the housing means 11 so as to be disposed within the heating chamber of the furnace to provide heat when the electrical heater unit or means 12 is interconnected to power source lead L1 and L2 by an electrical sequencing switch construction that is generally indicated by the reference numeral 13 in FIG. 1 and is carried by the housing means 11 within a substantially closed interior chamber 11' thereof.

Since the general construction and operation of the electrical heater construction 10 of this invention is the same as that described and claimed in the aforementioned copending patent application, Ser. No. 661,056, the details of the structure and operation of the electrical heater construction 10 need not be fully set forth in this application as the copending patent application can be referred to for such information, if necessary.

Thus, it is believed that only the general features of the electrical heater construction 10 need now be described in order to understand the improved features of this invention.

In particular, the housing means 11 includes a module 14 that contains two movable drawer-like members or units that are generally indicated by the reference numerals 15 and 16 and each of which is adapted to be disposed in an "in" position in the housing means 11 in the manner illustrated in FIG. 1 to electrically interconnect the power source leads L1 and L2 of the terminals 17 and 18 of the module 14 to L-shaped terminal means 19 and 20 respectively of the heater means 12 and control means 13. However, when the drawer means 15 and 16 are moved outwardly relative to the housing means 11, the same disconnect the power source terminal means 17 and 18 of the module 14 respectively from the terminals 19 and 20 of the heater means 12 and control means 13.

Each drawer 15 or 16 is provided with a pair of rigid lead means 21 and 22 which are respectively adapted to be disposed in electrical connection with the respective terminal means 19 and 20 of the heater means 12 and control means 13 when the respective drawer means 15 or 16 is disposed in the "in" condition of FIG. 1 while being out of electrical contact therewith when the drawer means 15 or 16 is pulled out relative to the housing means 11 as fully set forth in the aforementioned copending patent application.

Figure 3:
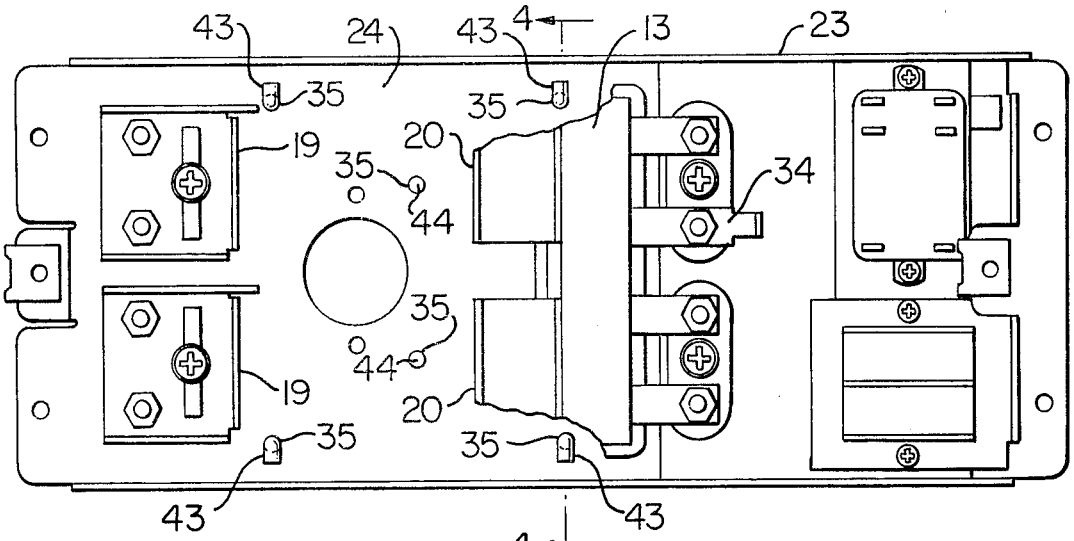
FIG. 3 is a view similar to FIG. 2 with the front cover and fuse module thereof removed.

As illustrated in FIG. 3, the housing means 11 includes a main frame plate 23 that closes off one end of the housing means 11 and which carried the control means 13 on the inner side 24 thereof as well as the upper and lower terminals 19 of the electrical heater means 12 respectively for the drawer-like units 15 and 16, the control means 13 also having upper and lower terminal means 20 for respectively being interconnected to the drawers 15 and 16.

A pair of upper and lower connector means 25 are carried by the housing plate 23 and project from the exterior side 26 thereof to be respectively interconnected by threaded fastening means 27 to adjacent ends 28 of upper and lower electrical heater elements 29 that are respectively carried by upper and lower brackets that are generally indicated by the reference numeral 30 and are detachably interconnected to the housing plate 23 in a manner hereinafter described.

The connector means 25 are respectively electrically interconnected to the upper and lower terminals 19 as illustrated.

Similarly, a pair of upper and lower connector means 31 are carried by the housing plate 23 and project from the exterior side 26 thereof to be respectively interconnected by threaded fastening means 32 to the other adjacent ends 33 of the upper and lower heater elements 29, the connector means 31 also projecting into the chamber 11' of the housing means 11 to be interconnected to the control means 13 by electrical connectors 34 and, thus, by the control means 13 to the terminals 20.

In this manner, the external power source leads L1 and L2 that are interconnected to the terminal means 17 and 18 of the module 14 of the housing means 11 are respectively interconnected to the opposed ends 28 and 33 of the heater elements 29 when the control means 13 determines that the heater elements 29 should be energized as the power source leads L1 and L2 are respectively interconnected to the connectors 25 and 31 respectively by the terminals 19 and 20 as long as the fuse drawers 15 and 16 are in the "in" condition as illustrated in FIG. 1.

Thus, it can be seen that the general operation of the electrical heater construction 10 of this invention is substantially the same as the operation of the electrical heater construction described and claimed in the aforementioned copending patent application and need not be repeated in this application.

However, as previously stated, it is a feature of this invention to permit the electrical heater unit 12 to be attached to the housing means 11 of the electrical heater construction 10 without requiring the opening of the housing means 11 so that the housing means 11 and its contents can be manufactured in one location and the electrical heater arrangement 12 can be attached thereto at another location without requiring the opening of the housing means 11.

Accordingly, the housing plate 23 is provided with a plurality of openings 35 which pass completely therethrough and provide detachable means of the housing means 11 that are accessible from the exterior thereof to permit the bracket means 30 to be detachably secured thereto.

In particular, each bracket means 30 comprises three spaced parallel rods 36, 37 and 38 respectively secured together in the spaced parallel relation thereof by a pair of transverse rods 39 and 40 welded or otherwise fastened thereto whereby the interconnected rods 36–40 can carry one of the heater elements 29 therewith as illustrated by means of interconnectors 41 on the rods 36–38 interconnecting with electrical insulators 42 of the heater element 29 in a manner conventional in the art.

Figure 4:
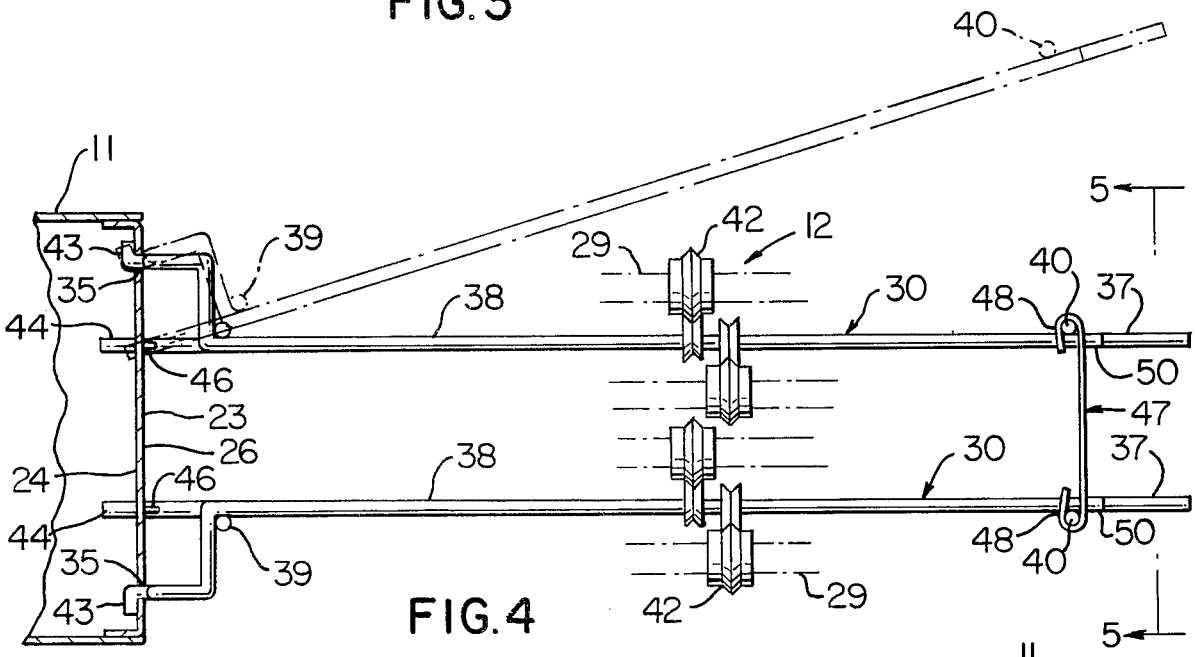
FIG. 4 is a fragmentary cross-sectional view taken on line 4—4 of FIG. 3 and illustrates the method of assembling the heater element bracket means to the electrical heater construction of this invention.

However, the rods 36 and 38 of each bracket 30 are respectively bent as illustrated in FIGS. 1 and 4 to have hooked ends 43 which are adapted to be respectively inserted in a pair of cooperating openings 35 of the housing plate 23 while the bracket 30 is disposed at an angle thereto as illustrated by dash-dot lines in FIG. 4 so that once the hook ends 43 are received through the openings 35, the bracket 30 can be rocked or rotated downwardly as illustrated in FIG. 4 to the full line position thereof while the projecting and non-hooked end 44 of the center rod 37 will be received in another cooperating opening 35 of the housing plate 23.

When the particular bracket 30 is moved to the horizontal position as illustrated in FIG. 4 in order to hook the hooked ends 43 of the rods 36 and 38 in the openings 35, it can be seen that bent sections 45 of the rods 36 and 38 adjacent the hooked ends 43 thereof abut against the exterior surface 26 of the housing plate 23 to position the bracket 30 in the horizontal position of FIG. 4. Such horizontal position of the bracket 30 of FIG. 4, also causes embossments 46 of the center rod 37 adjacent its projecting end 44 to abut against the external surface 26 of the housing plate 23 to properly position the bracket 30 in the horizontal position illustrated in FIG. 4.

The lower bracket 30 is likewise detachably interconnected to the housing plate 23 by having its hooked ends 43 hooked into the openings 35 of the housing plate 23 while the lower bracket 30 is angled in the opposite direction to the horizontal position relative to the housing plate 23 and is then rocked or rotated upwardly into the horizontal position as illustrated in FIG. 4 to cause its center rod 37 to have its non-hooked end 44 fully received into another opening 35 of the end plate 23.

In order to hold the brackets 30 in the horizontal spaced parallel position illustrated in FIG. 4, one or more fastening clips of this invention can be utilized and each fastening clip is generally indicated by the reference numeral 47.

Figure 6:
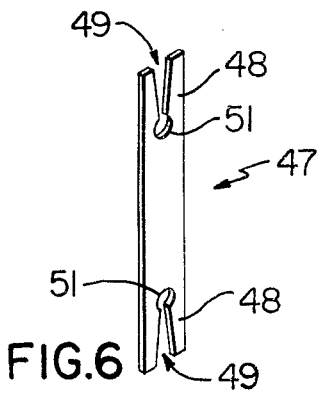
FIG. 6 is a perspective view of one of the fastening clips of this invention.

As best illustrated in FIG. 6, each fastening clip 47 is formed from a substantially flat sheet of metal or the like having opposed ends 48 respectively bifurcated by a key-hole-shaped slot 49 so that the slots 49 are adapted to receive the rearwardly projecting ends 50 of any adjacent pair of rods 36–38 of the upper and lower brackets 30 into the circular portions 51 thereof when the brackets 30 are disposed in the parallel horizontal position of FIG. 4. In this manner, the ends 48 of the clip 47 can then be bent over and around the transverse rear rods 40 of the upper and lower brackets 30 to hold and lock the same in the horizontal position of FIG. 4 so that the brackets 30 are positively fastened into the hooked assembled position of FIG. 4 to the housing means 11.

Thus, it can be seen that the electrical heater unit 12 of the two separate heater elements 29 can be readily attached to the housing means 11 of the electrical heater construction 10 of this invention by the method of this invention without requiring the opening of the housing means 11 in the manner now to be described.

Figure 5:
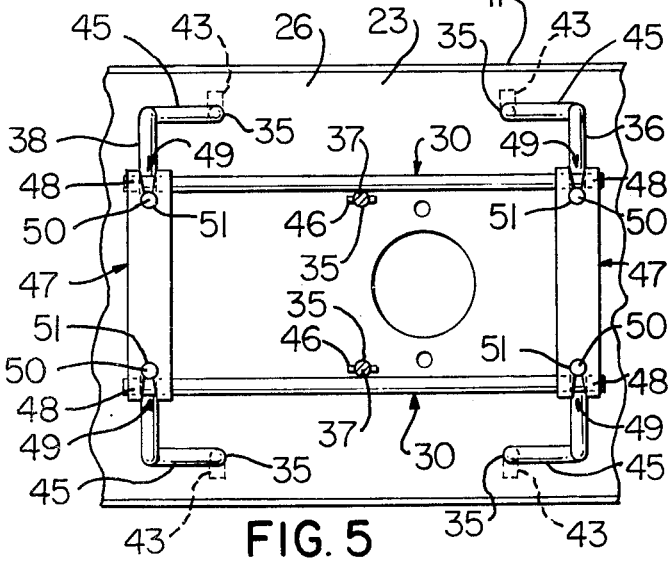
FIG. 5 is a fragmentary end view of the structure illustrated in FIG. 4 and is taken in the direction of the arrows 5—5 thereof.

As previously stated, the upper and lower brackets 30 together with their interconnected heater elements 29 can have the hooked ends 43 of the rods 36 and 38 thereof respectively hooked into the openings 35 of the housing plate 23 while the same are disposed at an angle relative thereto and then after the brackets 30 are rocked into the horizontal parallel relation illustrated in FIG. 4 wherein the bent sections 45 of the rods 36 and 38 abut against the exterior surface 26 of the housing plate 23 and the ends 44 of the center rods 37 are fully received into cooperating openings 35 while the abutments 46 thereof abut the exterior surface 26 of the plate 23, one or more of the fastening clips 47 of this invention can be utilized to fasten brackets 30 into the assembled relation illustrated in FIG. 4 by having the opposed ends 48 thereof bent around the rear cross rods 40 thereof while the same receives the adjacent ends 50 of a like pair of rods 36, 37 or 38 of the upper and lower brackets 30 in the circular openings 51 thereof as illustrated in FIGS. 4 and 5.

For example, instead of utilizing two fastening clips 47 at the end pair of rods 36 and 38, a single clip 47 could be utilized at the ends 50 of the center rods 37, as desired.

Should it be desired to subsequently remove such an attached electrical heater unit 12 from the housing means 11, all that is required is the unfastening of the fastening clip or clips 47 therefrom by straightening out the bent ends 48 thereof and removing the clip or clips 47 from the brackets 30 whereby the brackets 30 can be rocked back to an angle relative to the housing plate 23 to remove the hooked ends 43 from the opening means 35 thereof in a simple manner.

Thus, it can be seen that this invention provides means whereby the electrical heater unit 12 can be attached to or detached from the housing means 11 of the electrical heater construction 10 in a manner that is accessible to the exterior of the housing means 11 so that the housing means 11 need not be opened to attach or detach the electrical heater unit 12 thereto or therefrom as the case may be.

Accordingly, it can be seen that this invention not only provides an improved electrical heater construction, but also this invention provides an improved method of making such an electrical heater construction or the like.

While the form and method of this invention now preferred have been illustrated and described as required by the Patent Statute, it is to be understood that other forms and method steps can be utilized and still fall within the scope of the appended claims.

What is claimed is:

1. In an electrical heater construction having a substantially closed housing means containing control means therein and having bracket means carrying electrical heater means externally thereof, said housing means having connection means detachably interconnected to said heater means externally to said housing means and electrically interconnecting said electrical heater means to said control means to be operated thereby, the improvement wherein said housing means has externally accessible detachable means and said bracket means has detachable means detachably interconnected to said detachable means of said housing means in a manner that is accessible externally to said housing means whereby said detachable means of said bracket means can be detached from said detachable means of said housing means without access to the interior of said housing means so that said heater means can be detached from said housing means without requiring the opening of said housing means.

2. An electrical heater construction as set forth in claim 1 wherein said control means includes fuse drawer means movable into and out of said housing means.

3. An electrical heater construction as set forth in claim 1 wherein said detachable means of said housing means comprises a plurality of openings therein that receive said detachable means of said bracket means.

4. An electrical heater construction as set forth in claim 3 wherein said detachable means of said bracket means includes a hook projection that is rockingly hooked into one of said opening means of said housing means.

5. An electrical heater construction as set forth in claim 4 wherein said hook projection has an external abutment section that abuts the exterior of said housing means to position said bracket means in said hooked condition thereof.

6. An electrical heater construction as set forth in claim 4 wherein said bracket means has two said hook projections that are respectively rockingly hooked into two of said opening means of said housing means.

7. An electrical heater construction as set forth in claim 6 wherein said bracket means has a non-hooking projection that projects into one of said opening means of said housing means when said two hook projections are being hooked into their respective openings.

8. An electrical heater construction as set forth in claim 4 wherein said bracket means comprises two separate brackets each of which has a hook projection that is rockingly hooked into one of said opening means of said housing means in spaced relation to the hook projection of the other bracket.

9. An electrical heater construction as set forth in claim 8 and including fastening means fastening said brackets together in their hooked positions whereby said brackets cannot have their respective hook projections unhooked from their respective opening means in said housing means until said brackets are unfastened from each other by said fastening means.

10. An electrical heater construction as set forth in claim 9 wherein said fastening means comprises a clip member having opposed ends respectively bent around parts of said brackets to fasten the same in their hooked positions.

* * * * *